US008468950B2

(12) United States Patent
Wicks et al.

(10) Patent No.: US 8,468,950 B2
(45) Date of Patent: Jun. 25, 2013

(54) INTERMODAL RAIL VEHICLE TO FORM A TRAIN

(75) Inventors: Harry O. Wicks, El Paso, TX (US); Michael W. DiLuigi, Alpharetta, GA (US)

(73) Assignee: Railrunner, N.A., Inc., Lexington, MA (US)

( * ) Notice: Subject to any disclaimer, the term of this patent is extended or adjusted under 35 U.S.C. 154(b) by 318 days.

(21) Appl. No.: 12/746,580

(22) PCT Filed: Dec. 11, 2008

(86) PCT No.: PCT/US2008/086370

§ 371 (c)(1), (2), (4) Date: Jun. 7, 2010

(87) PCT Pub. No.: WO2009/085632

PCT Pub. Date: Jul. 9, 2009

(65) Prior Publication Data

US 2010/0242787 A1 Sep. 30, 2010

Related U.S. Application Data

(60) Provisional application No. 61/015,545, filed on Dec. 20, 2007.

(51) Int. Cl.
*B61F 3/12* (2006.01)

(52) U.S. Cl.
USPC ..... 105/4.1

(58) Field of Classification Search
USPC ..... 105/4.1–4.4, 159; 213/75 R
See application file for complete search history.

(56) References Cited

U.S. PATENT DOCUMENTS

| | | | | |
|---|---|---|---|---|
| 3,628,465 | A | 12/1971 | Dobson et al. | |
| 5,020,445 | A | 6/1991 | Adams, Jr. | |
| 5,291,835 | A | 3/1994 | Wicks | |
| 5,431,110 | A | 7/1995 | Adams, Jr. | |
| 5,890,433 | A | 4/1999 | Wicks | |
| 5,890,435 | A | 4/1999 | Thoman et al. | |
| 6,050,197 | A | 4/2000 | Wicks | |
| 6,393,996 | B1 | 5/2002 | Duncan et al. | |
| 6,575,101 | B2 * | 6/2003 | Blute et al. | 105/215.2 |

FOREIGN PATENT DOCUMENTS

| | | |
|---|---|---|
| DE | 35 10 454 A1 | 10/1985 |

* cited by examiner

*Primary Examiner* — S. Joseph Morano
*Assistant Examiner* — Zachary Kuhfuss
(74) *Attorney, Agent, or Firm* — Leydig, Voit & Mayer, Ltd

(57) ABSTRACT

Refinements and improvements in intermodal rail vehicles for making up a train of highway trailers are shown. The improved intermodal vehicle has a one-piece upper frame assembly (26) with a horizontal load carrying surface below the ends of a drawbar for connecting the trailers. Each highway trailer has a coupler socket assembly at both its front and rear into which the drawbar enters and is connected to the intermodal vehicle by a vertical coupling pin projecting upward from the horizontal load carrying surface. The upper frame is supported from dual steerable lower frames (28) by primary air springs (90). A backup suspension system is provided so as to support the upper frame in the event of failure of the primary air springs. A transition rail vehicle for adapting the unit train of trailers is provided, incorporating the necessary features of the intermediate intermodal vehicles heretofore described.

7 Claims, 14 Drawing Sheets

INTERMODAL RAIL VEHICLE TO FORM A TRAIN

BACKGROUND OF THE INVENTION

The above prior art discloses novel intermodal vehicles for use in forming a train of highway trailers including leading and trailing trailers interconnected to each other and supported by the intermodal vehicles. The intermodal rail vehicle of the present disclosure may be used with trailers of any configuration, including trailers designed for hauling "ISO" shipping containers. Each of the highway trailers includes a coupler socket assembly at its leading end and a coupler socket assembly at its trailing end. Each socket assembly is provided with a pair of vertically spaced apart aligned apertures for receiving a vertical coupling pin. The intermodal vehicles are characterized by two lower frame assemblies, each supported by a rail wheel and axle assembly and a one-piece upper rifting frame assembly supported by the two lower frame assemblies by spring means. The spring means include air springs which are arranged so that when air is evacuated air from the air springs, the upper lifting frame will descend toward the lower frame assemblies and when air is added to the air springs, the upper lifting frame will rise and concurrently raise any trailers resting thereon to a height sufficient so that the trailer wheels are clear of the railroad track. In addition to this primary spring means, a secondary spring means is provided so as to support the trailer above the track in the event of failure of the primary air springs. In addition to a horizontal trailer support surface, the upper lifting frame includes a coupler tongue, or drawbar, which is formed to be received in the coupler socket of the trailer. Each end of the coupler tongue is provided with an aperture for receiving a vertical coupling pin which rises from the upper lifting frame to pass through the coupler socket assembly in the trailer and at the same time pass through the coupler tongue within the socket, thus effecting a connection between the intermodal vehicle and the trailer resting thereon. It is also a feature of the prior art that the lower frames are steerable with respect to the upper frame assembly. The prior art also discloses a transition vehicle or other means for connecting a unit train of intermodal vehicles having a unique coupling system to the "knuckle" couplers found on conventional trains.

The prior art has validated the idea of making a train of highway trailers with steerable intermodal vehicles which permit the make-up of a train without the need for cranes or other lifting devices; however, these prior intermodal vehicles are unnecessarily complex and it is beneficial to the art to provide a simplified intermodal vehicle of an improved design which corrects some of the weaknesses and complications found in the prior art.

OBJECTS AND SUMMARY OF THE INVENTION

It is the object of the present invention to provide an improved intermodal vehicle wherein the upper load supporting frame is a one-piece welded assembly which is supported by two lower steerable lower frame weldments; there being coupler tongues in the form of a two level coupler tongue/drawbar assembly in a fixed relationship to the load supporting surfaces on the upper frame assembly, said drawbar assembly having front and rear vertically extending apertures which receives a vertically movable coupler pin extending from the upper frame assembly for securing the intermodal vehicle to front and rear highway trailers.

In the prior art, U.S. Pat. Nos. 5,291,835 and 5,890,435 show four air springs, one over each rail wheel. U.S. Pat. Nos. 6,050,197 and 6,393,996 (called "996") show eight air springs, one at each corner of the two lower frame assemblies. In all these patents, a provision is made for a backup suspension system which will support the upper frame in the event of a failure of the primary air springs. In U.S. Pat. Nos. 5,291,835 and 5,890,435, the backup support is provided by a solid rubber cushion internal to each air spring; U.S. Pat. No. 996 provides a backup system consisting of eight steel coil springs positioned between the two lower frames and the upper frame assembly. The coil springs of the 996 patent require that pressure plates ("paddles") be in position above the coil springs when the intermodal vehicle is raised to the rail travel position and that the pressure plates be moved away to allow the upper frame to be lowered. This positioning of the pressure plates is accomplished by a system of levers and operating rods interconnected to the cover of the control valve box. It is an object of the present invention that urethane bumpers mounted to the side beams of the lower frame assemblies are used in lieu of the coil springs, and movable pressure beams are to be mounted to the upper lifting frame and positioned above these bumpers. In the preferred embodiment, shifting of the pressure beams to a position above the bumpers is accomplished by air cylinders and to a position away from the bumpers by a manual operating lever. Alternatively, the pressure beams may be operated wholly by mechanical means or wholly by air cylinders.

In the prior art of U.S. Pat. No. 996, the drawbar for coupling the trailers to the intermodal vehicle is at the same height above the track at each end. On a trailer, the coupler socket at the front end is at a different height from the rear end; as a consequence, a train of trailers will not run level on the tracks if both ends of the drawbar are at the same height from the track. An object of the present invention is to provide a drawbar with one end higher than the other; thus the trailers will run level on the tracks.

In the prior art of U.S. Pat. No. 996, activation of the coupling pin is accomplished by a double acting air cylinder acting through a system of levers. A disadvantage of this is that the cylinder rod is exposed to grit and grime which will shorten the life of the cylinder and presents a potential safety issue. An object of the present invention is for the operation of the coupling pin to be through the use of all-rubber air actuators as manufactured by Firestone Rubber Company. These actuators are similar to the air springs used in the primary suspension of the intermodal vehicle, albeit smaller, and have no metal parts which could be damaged by exposure to deleterious conditions.

In the prior art of U.S. Pat. No. 996, the steerable lower frames are returned to their neutral center position by vertical guide rods which pass through the upper and lower plates of rubber-in-shear "sandwich" springs. These springs are directly in the path of dirt, grime and oil thrown up from the track bed during normal rail travel; this exposure is highly destructive to the rubber springs. An object of the present invention is that these rubber springs be replaced by a return assembly using urethane elements which are unaffected by the aforementioned deleterious matter and at the same time the guide rods function also to limit the lifting height provided by the air springs as well as to prevent the upper frame from separating from the lower frames.

The prior art of U.S. Pat. No. 996 shows a ball joint at the connection between the lower frames to accommodate rocking and other motions between the frames. This ball joint arrangement is prone to wear and possible premature failure of the connection because of longitudinal shock in the ball joint as the train travels along the track. Therefore, a further object of the present invention is to allow the connecting elements from the opposite lower frames to be in contact, thus eliminating longitudinal movement. In lieu of the ball connection, an "hourglass" shaped aperture in the center element is provided to allow for rocking and rolling motions. Rotational movements of the frames relative to one another are provided for by rounding the ends of the connecting elements. In addition, in order to further cushion possible longitudinal movement, bumpers are provided between the frames.

In the prior art of U.S. Pat. No. 996, to facilitate the positioning of the rear of the trailer upon the intermodal vehicle, a sloping ramp is provided, which serves as a guiding and centering means for the trailer by contacting the trailer's frame. No provision is made for centering the front of the trailer. In the procedure for making up a train, an intermodal vehicle is positioned on the track and a trailer, propelled by a yard tractor, is backed upon the intermodal vehicle. The yard tractor continues to push the trailer and intermodal vehicle back into engagement with the front end of a second trailer. The tractor then unhooks from the trailer and pulls away. An object of the present invention is to provide "lugs" on the feet of the second trailer's landing gear which will contact the inner surfaces of the track heads, thus centering the end of the trailer with respect to the intermodal vehicle.

In the prior art as well as the present invention, the connection of the intermodal vehicle to the trailer is accomplished by entry of the ends of a drawbar attached to the intermodal vehicle into sockets in the trailers and fixed therein by a coupling pin rising from the vehicle through the upper and lower plates of the coupler socket and at the same time through an aperture in the drawbar.

As an alternative however, an automatic coupling means may be useful in some situations; for example in a short, "sprint" train where speed of train make up may be a factor. Accordingly an automatic coupler means is shown as an alternate to the coupling means shown on the patents of the prior art and is described herein.

A transition vehicle for coupling the train of trailers with standard "knuckle" couplers for connecting the trailers of this invention to standard railcars or a locomotive is shown in U.S. Pat. No. 6,393,996 and will not be further described.

The foregoing design features of the present invention will be better understood after a consideration of the following detailed description in conjunction with the accompanying drawings in which the best way of practicing this invention is illustrated.

BRIEF DESCRIPTION OF THE DRAWINGS

FIG. 1 showing the trailers and an intermodal vehicle before makeup, with the rail vehicle being shown in the down position, and FIG. 2 showing the intermodal vehicle connected to the trailers with the intermodal vehicle in its raised position.

IN GENERAL

Figure 1:
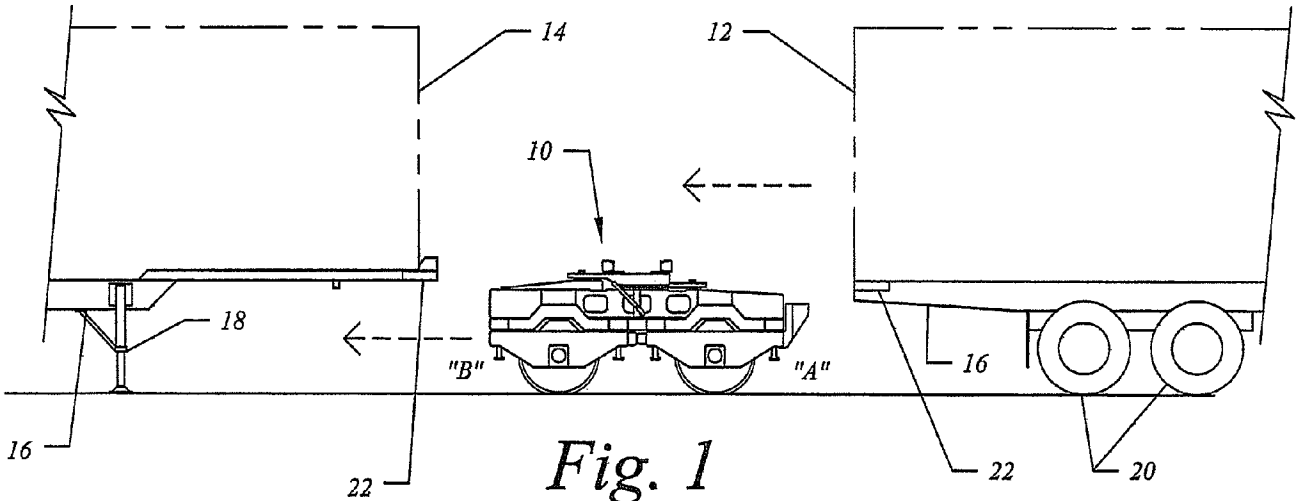
FIGS. 1 and 2 illustrate how a train can be made up using leading and trailing highway trailers and an intermodal rail vehicle.
Figure 2:
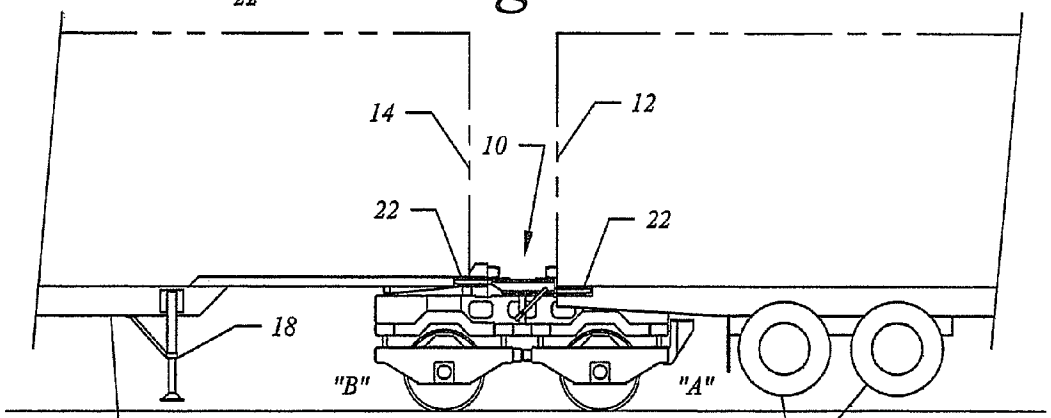

In the following description right and left hand references are determined by standing to the rear of one of the trailers and facing the direction of travel. With reference initially to FIGS. 1 and 2, the intermodal vehicle of this invention may be used in conjunction with other intermodal designs and highway trailers of any style to form a train of highway trailers. The front end of the train thus formed is supported by a transition vehicle as shown in U.S. Pat. No. 6,393,996, incorporated by reference herein, which has a standard "knuckle" coupler on one end for coupling to a standard railcar or locomotive and a coupler tongue at the other end for coupling to the trailer socket of this invention. The rear end of the train of trailers is similarly supported by another of said transition vehicles.

With reference now to FIGS. 1 and 2, the intermodal vehicles are indicated generally at 10, a highway trailer indicated generally at 12, and another highway trailer is indicated generally at 14. The highway trailers 12 and 14 are similar to the trailers shown and described in U.S. Pat. No. 6,393,996. Initially it should be observed that all of the highway trailers for use with this invention are of the same configuration. Thus, the trailer 12 is identical to the trailer 14.

Each of the highway trailers is provided with a main frame 16 consisting of a pair of longitudinally extending spaced apart centrally located rails which may be used to guide the rear end of the leading trailer onto the intermodal vehicle of this invention by contacting a centering guide on the intermodal vehicle. In addition, each of the trailers is provided with a forward landing gear 18 and highway wheel assemblies including wheels 20.

As previously stated, each highway trailer is provided with front and rear identical coupler sockets 22. The rear trailer socket is higher from the ground than the front trailer socket.

Details of the coupler socket are shown and described in U.S. Pat. No. 6,393,996. In any event, each coupler socket may receive one end of a coupler tongue, or drawbar, and it should be noted that the drawbar, fastened to the top of the intermodal vehicle is higher for the front of a trailer and lower for the rear of a trailer. This so that, when running on the track, the trailers will be substantially level. Each socket assembly is further provided with vertically spaced apart aligned apertures to facilitate securing one end of the drawbar assembly within the socket assembly by means of a vertical coupler pin carried by the upper frame of the intermodal vehicle.

The Intermodal Vehicle

Figure 3:
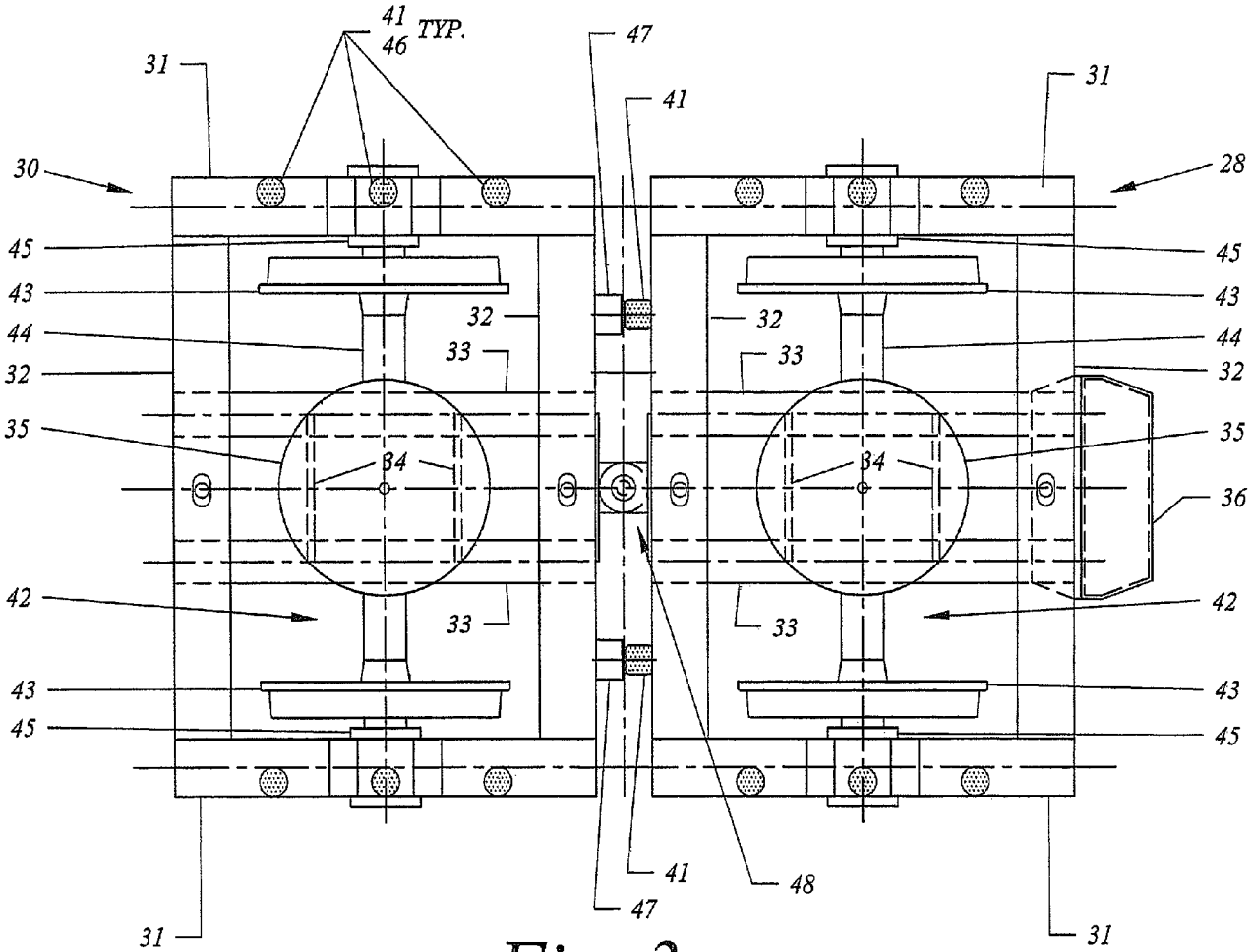
FIG. 3 is a plan view of the lower frames.
Figure 3A:
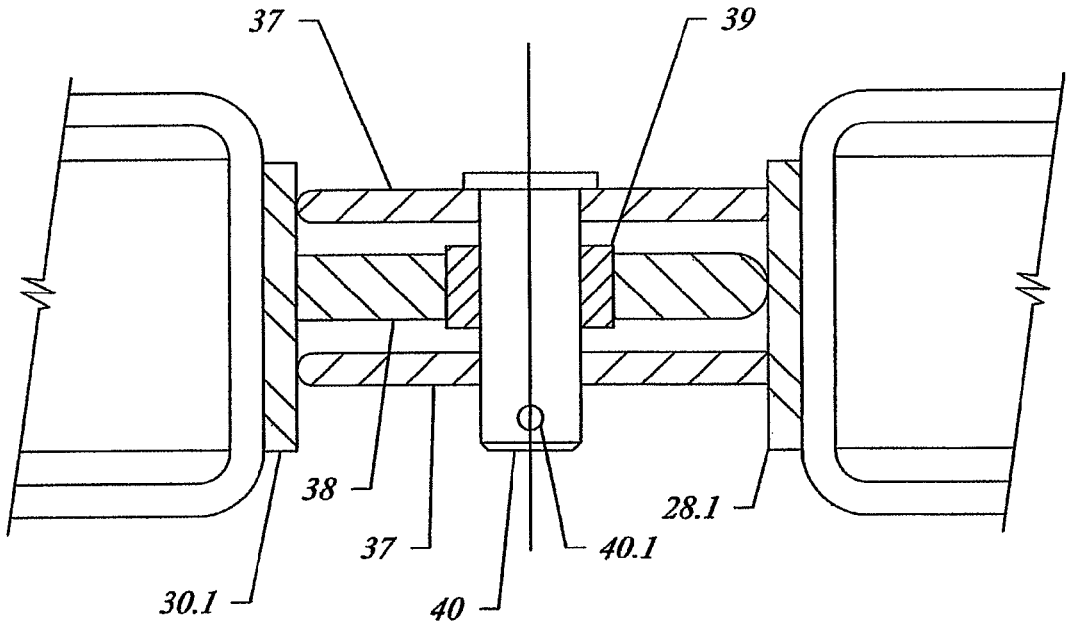
FIG. 3A is an enlarged side view of the connection between the two lower frames.
Figure 3B:
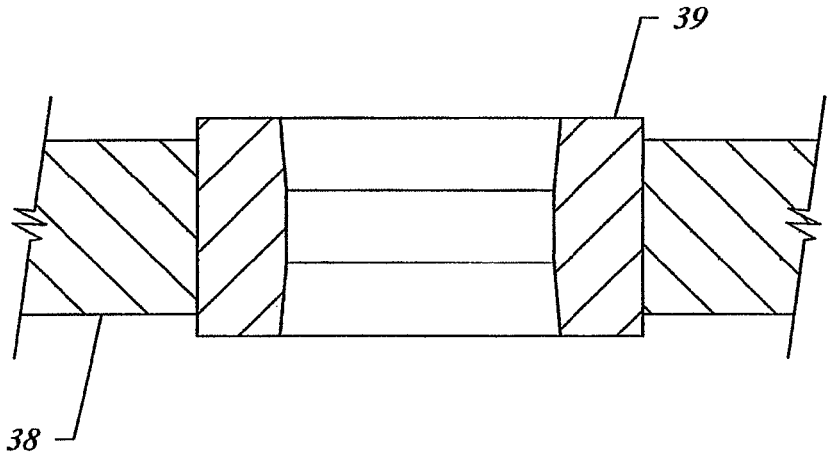
FIG. 3B is a cross-section of the bushing in the central connection bar.
Figures 4, 4A:
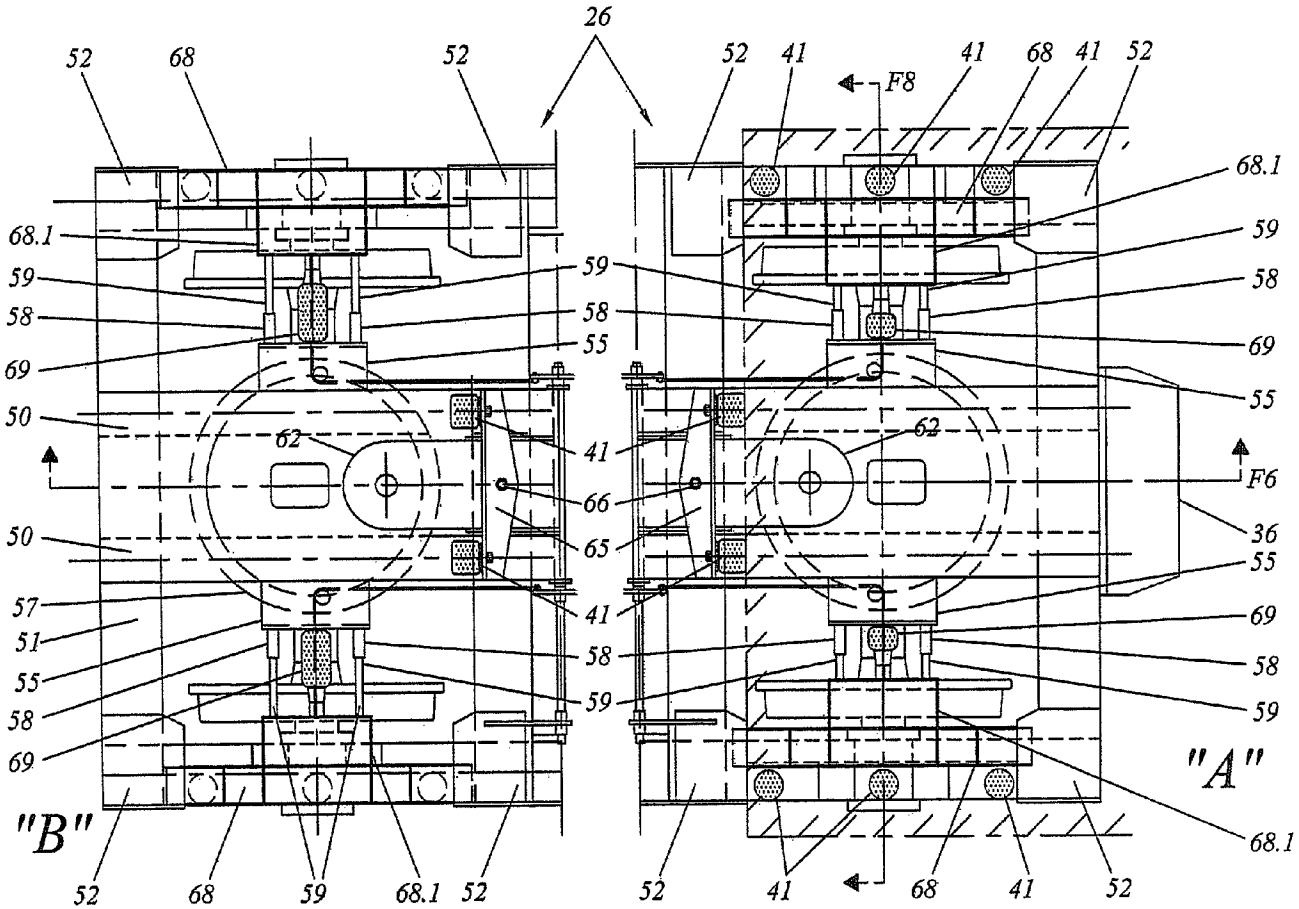
FIG. 4 is a part plan view of the top frame in the running position.
FIG. 4A is a part plan view of the top frame in the retracted position.
Figure 5:
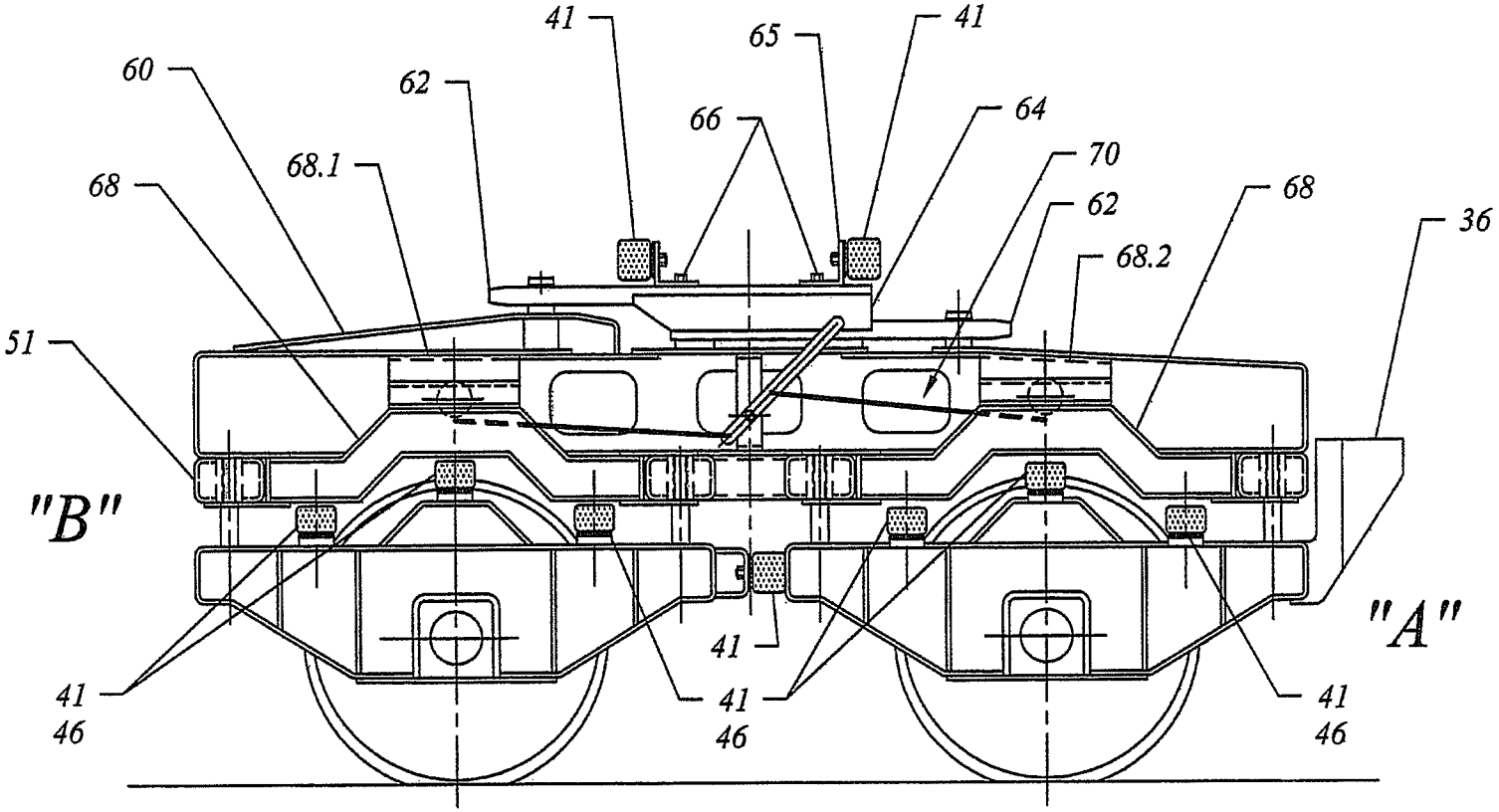
FIG. 5 is a side view of the vehicle in the raised position.
Figure 5A:
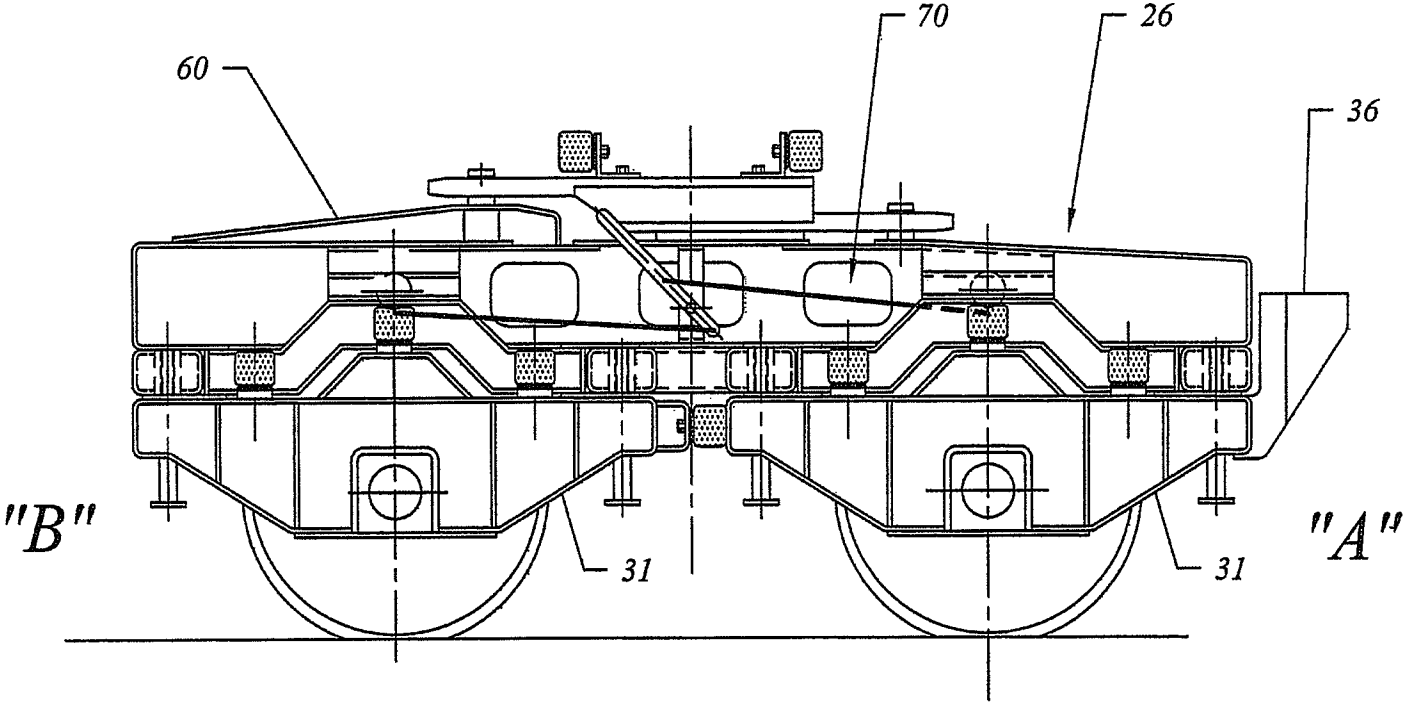
FIG. 5A is a side view of the vehicle in the retracted position.

With reference to FIGS. 3 through 8A, the internodal vehicle of this invention consists of an upper frame weldment indicated generally in plan view at 26 in FIGS. 4 and 4A and in elevation in FIGS. 5 and 5A; a leading lower frame weldment generally in plan view at 28 in FIG. 3 and in elevation in FIGS. 5 and 5A and a trailing lower frame weldment generally in plan view at 30 in FIG. 3 and in elevation in FIGS. 5 and 5A. The main components of the lower frame weldments are (two) side frame weldments 31, (two) transverse cross channels 32, (two) longitudinal spring support beams 33, (two) transverse spring support bars 34 and one spring support plate 35. These two lower frame weldments are essentially identical except for the connector assembly which is used to connect the lower frame weldments to one another, and to connect a trailer centering and guide weldment 36 on the lower frame weldment to center the trailer on the intermodal vehicle during the train makeup procedure. Thus, the lower frame weldment 28 is provided with a single connector plate 38 which receives a bushing 39. The central portion of bushing 39 is so designed that at its center section it will receive a connection pin 40 as shown in FIG. 3A. The bushing is tapered in three parts, top to bottom, approximately 5 degrees so the connection pin may rock fore, aft and side to side as the two lower frame weldments themselves rock during transit. The "A" lower frame weldment differs from the "B" lower frame weldment in that it has upper and lower spaced apart coupling plates 37 and the aforementioned guide weldment 36. When the two lower frame weldments are coupled to each other, the coupling pin is inserted within the aligned apertures in coupling plates 37 and bushing 39 and held in place by pin 40.1. It should be noted that coupling plates 37 touch a wearplate 30.1 on the cross channel of lower frame weldment 30 and the coupling plate 32 touches the wearplate 28.1 on the cross channel of lower frame weldment 28. Additionally, and as part of the connection of the two lower frame weldments above described, two urethane "Tekspak" bumpers 41 as manufactured by S.W. Miner Co. and best shown in FIG. 3 are mounted near each outer end of cross channel of lower frame weldment 28.

Two air springs 90 are provided. The springs are Firestone no. 148-1, which have a load capacity of approximately 56,000 lbs at an air pressure of 80 p.s.i. In this invention, the springs, with a bead ring are fastened to the upper mounting plates 57 of the upper frame and to a lower plate with a central downward projecting bolt which is supported by and pivoted from mounting plates 35 of the lower frames. When air is introduced into the air springs, the upper frame assembly will rise and lift the superimposed trailers. When air is evacuated from the air springs, the upper frame will descend so that the superimposed trailers may by removed and different trailers positioned thereon.

Figure 7:
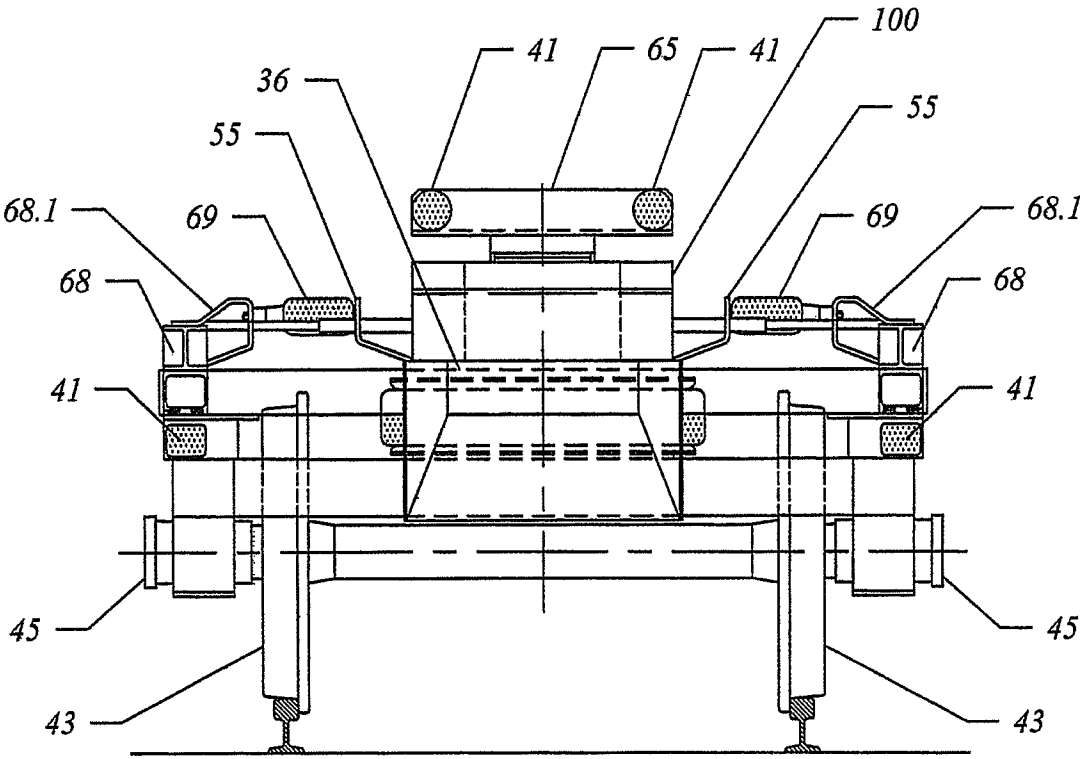
FIG. 7 is a view of the "A" end of the vehicle.

Each of the "A" end and "B" end lower frame weldments receive a rail wheel assembly 42, all rail wheel assemblies being identical, and each of the rail wheel assemblies having spaced apart rail wheels 43 carried by a live axle 44. The ends of axle 44 are received within suitable bearing assemblies 45 of conventional design. The bearing assemblies are mounted within each of the lower frame weldments. It can be seen that the two lower frame weldments and wheel assemblies form a portion of a steerable rail truck. Thus, each of the lower frame weldments can pivot with respect to each other about the vertical center line of the connector pin 40. In addition, they can twist or rock as the bushing 39 permits such movement. Each side frame weldment 31 includes three urethane "Tekspak" bumpers 41, the function of which will be described later herein. Referring to FIG. 7, the rear view of the intermodal vehicle is shown at the "A" end, with the guide assembly 36 clearly visible. The guide, as mentioned before, assists the trailer in backing upon the intermodal vehicle by centering it as it "climbs" the ramped end of the upper frame. When the intermodal vehicle is raised, the trailer frame members no longer touch the guide.

Figures 6, 6A:
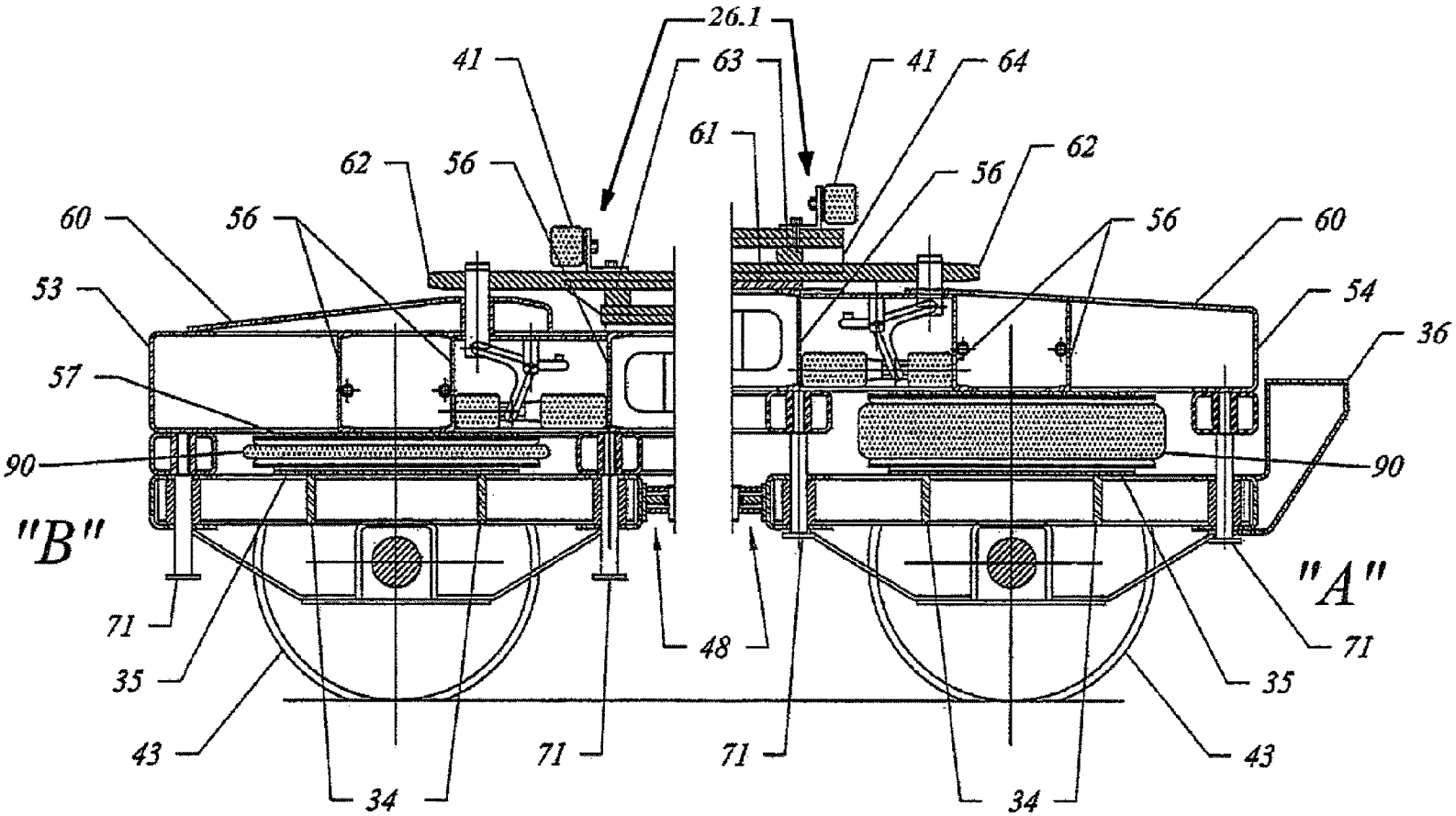
FIG. 6 is a longitudinal section of the vehicle in the raised position.
FIG. 6A is a longitudinal section of the vehicle in the retracted position.
Figures 8, 8A:
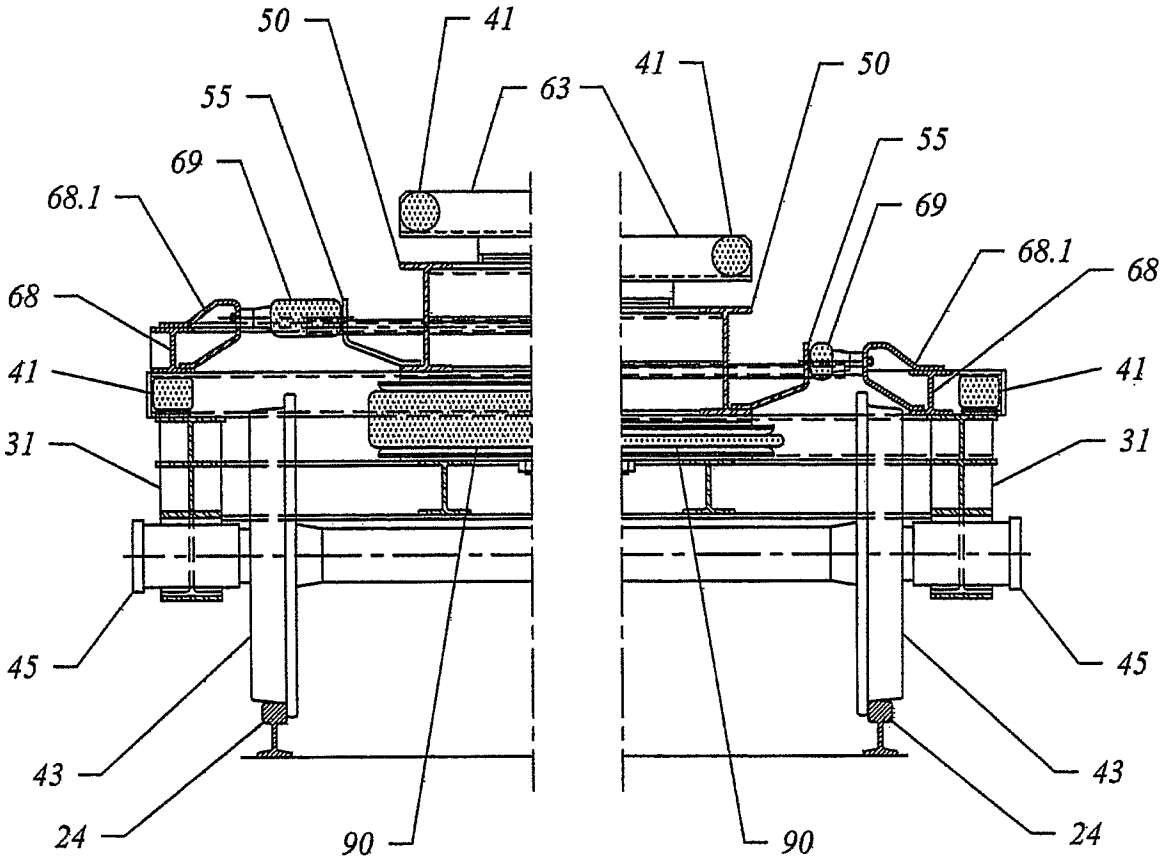
FIG. 8 is a partial cross-section of the vehicle in the raised position.
FIG. 8A is a partial cross-section of the vehicle in the retracted position.

With reference to FIGS. 4 and 4A, the upper frame weldment 26 is shown in plan view and is shown also in FIGS. 6 and 6A in sectional elevation. The main components of the upper frame weldment are two longitudinal "I section" beams 50, four crossmembers 51 of structural tubing, guide plates 52, sixteen in number, are attached to the outer ends at the top and bottom of the crossmembers. End channels 53 and 54 are provided at the outer ends of the beams 50. Four brackets 55, for mounting the operating cylinders are attached to beams 50. Interior crossmembers between the longitudinal beams are provided for mounting the coupler pin operators and to support the airspring mounting plate 57. Tubes 58 for directing guide rods 59 are provided. Support plate 60 is fastened to the "B" end of the upper frame for supporting the front end of a trailer, while at the "A" end of the upper frame, the longitudinal beams 50 are ramped to guide and support the rear of a trailer. Plate 61 for mounting the coupler assembly spans the longitudinal beams as is better shown in FIG. 6. The coupler assembly 26.1 is a weldment comprised of two coupler tongues 62, two spacers 63 and gussets 64. At the top of the assembly weldment, angle brackets 65 are pivoted by mounting bolt 66 from the upper coupler tongue. At the outer ends of the angle brackets, "Tekspak" bumpers 41 are mounted. This arrangement provides pressure against the end of the trailer during rail travel to cushion any slack in the coupling. At the center of each cross tube, a threaded block 67 is provided into which a vertical steering return bar is threaded. This arrangement is better shown in FIGS. 11, 12 and 13. As is shown in plan in FIGS. 4 and 4A and in elevation in FIGS. 5. and 5A, pressure bars 68, four in number, slide in and out between the guide plates 52. When the pressure bars are in the outward position, the running position when operating on the tracks, they prevent the upper frame assembly from lowering. When in the inward position, the position for train make-up and break-up, they allow the upper frame to lower. As previously described, in FIG. 8, pressure bar 68 is directly above the urethane bumper 41, thus preventing the lowering of the upper frame of the intermodal vehicle, in FIG. 8A, the pressure bar 68 is shown in the inward position, thus allowing the upper frame of the intermodal vehicle to be lowered as shown. The operation of the pressure bars outward is by air actuators 69 as manufactured by Firestone Industrial Products operating against a bracket 68.1 attached to the pressure bar and inward by a cable arrangement shown generally as 70. Guide rods 59 attached to the pressure bar brackets 68.1 operate within the aforementioned guide tubes 58. As an alternate, a double acting cylinder may be used in lieu of the air actuators and cable arrangement. Referring to FIGS. 8 and 8A, the pressure bars 68 are shown in both the in and out positions.

Figure 11:
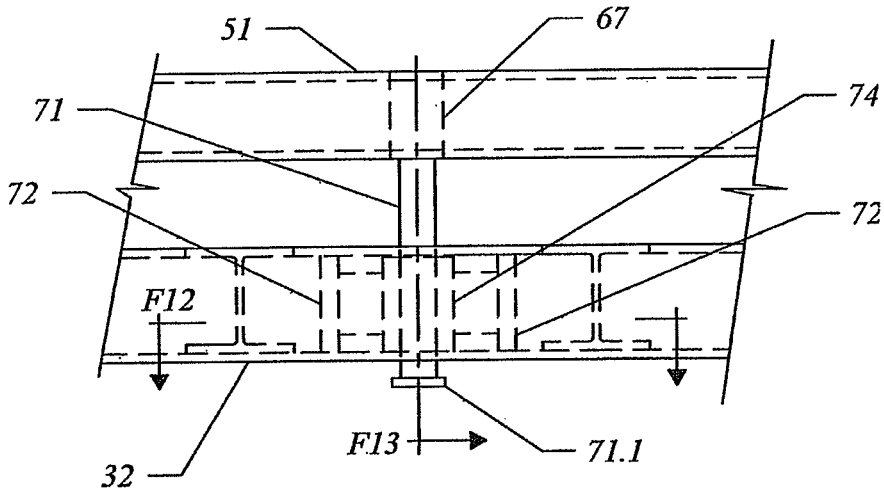
FIG. 11 is a view of the steering return spring.
Figure 12:
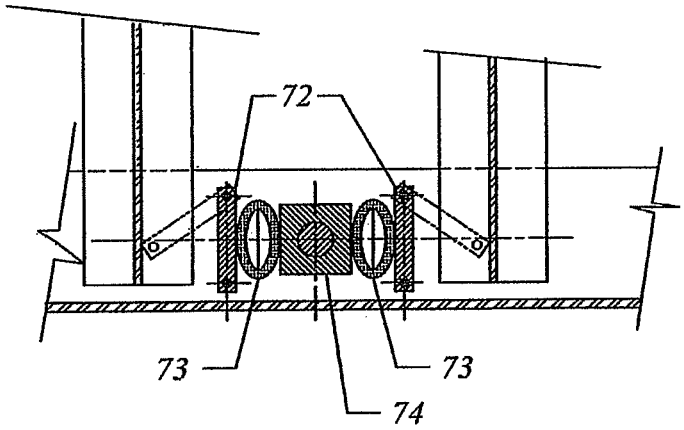
FIG. 12 is a section through the steering return spring.
Figure 13:
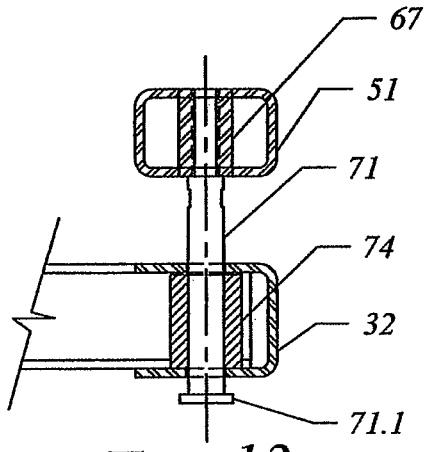
FIG. 13 is a section through the steering return spring.

Referring now to FIGS. 11, 12 and 13 which show the steering return scheme. Threaded block 67 is fastened to crossmember 51 of the upper frame at its center. In the transverse channel 32 of the lower frame, swinging stop bars 72 are provided. A loose block 74 having a vertical hole rests between two tubular urethane spring members 73 which are fastened to the block. The vertical steering bar 71 passes upward through the channel 32 and the block 74 and is threaded into threaded block 67. The vertical steering bar 71 has on its lower end a flange 71.1 which serves as a limit to prevent the upper frame from being lifted high enough so it becomes detached from the lower frames. When the vertical steering bar is thus attached to the upper frame, the swinging stop bars 72 are swung into their proper position and put pressure on the tubular spring members 73.

Figure 9:
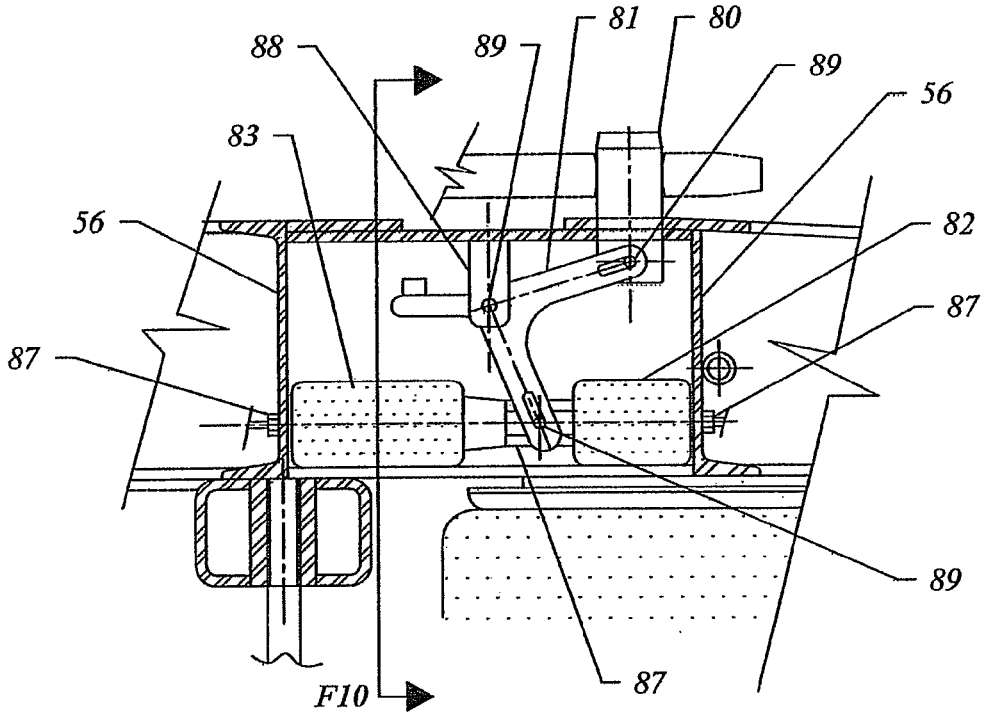
FIG. 9 is an enlarged view of the coupling pin operating mechanism.
Figure 10:
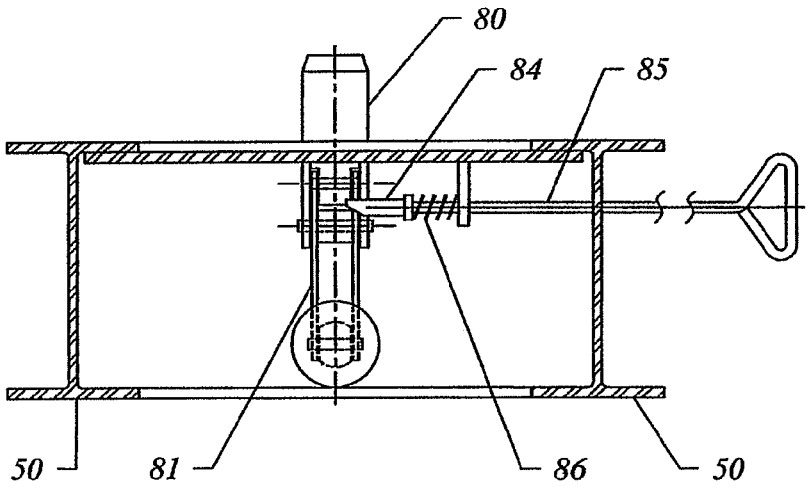
FIG. 10 is a cross-section of the coupling pin operating mechanism.

With reference now to FIGS. 9 and 10 which show enlarged views of the coupling pin operating mechanism shown in FIGS. 6 and 6A. Thus, the coupling pin 80 is supported, raised and lowered by spaced apart bell crank levers 81 activated by rubber actuators 82 and 83, as manufactured by Firestone Industrial Products Company, fastened to crossmembers 56 transverse to the intermodal vehicle upper frame members so that when air is introduced in one actuator and evacuated from the other actuator, the bell crank levers will raise or lower the coupling pin 80. Air is introduced into the actuators through hollow mounting bolt 87 which has threads on its outer surface for bolting the rubber actuator to the frame crossmembers 56 and also has internal threads to provide a means for attaching the appropriate fitting for the air inlet. The levers 81 are pivoted from bracket 88 and cylinder connector block 87 by pivot pins 89. A safety latch 84 attached to handle 85 and held in place by spring 86 engages one of the levers 81 to prevent the coupler pin from descending until manually released.

Figure 14:
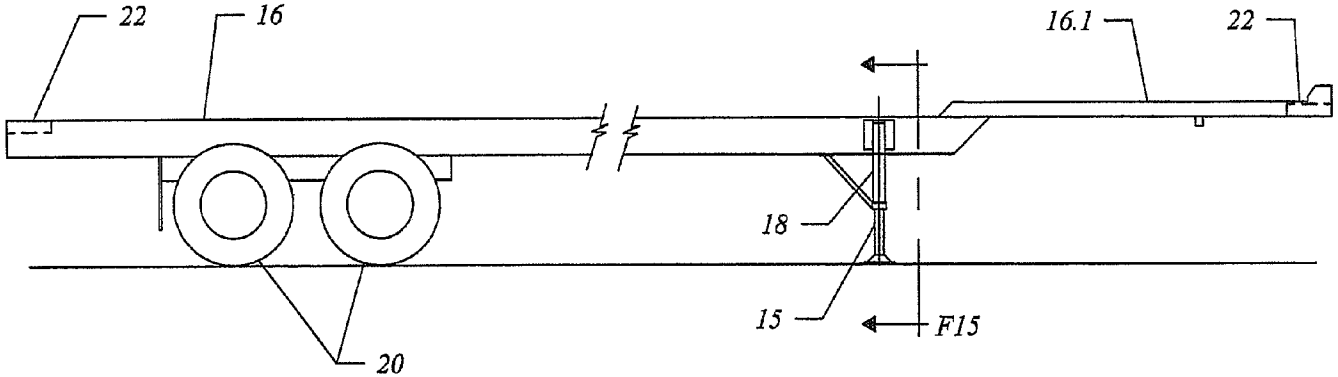
FIG. 14 is a side view of a trailer equipped to carry ISO containers.
Figure 15:
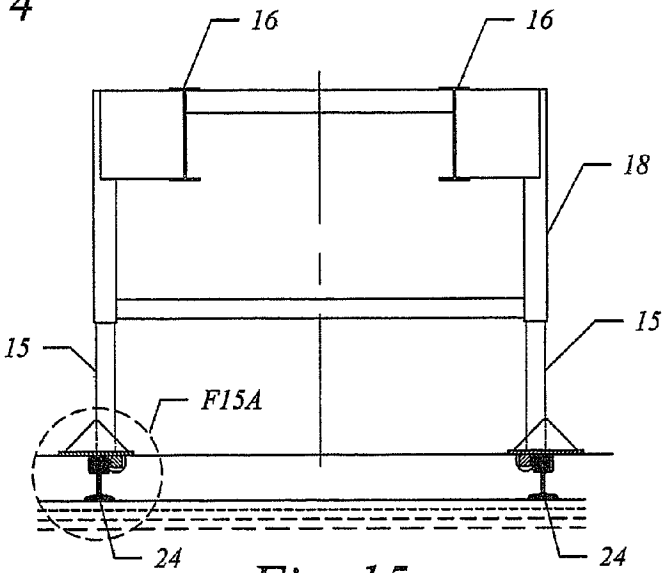
FIG. 15 is a view of the trailer landing gear.
Figure 15A:
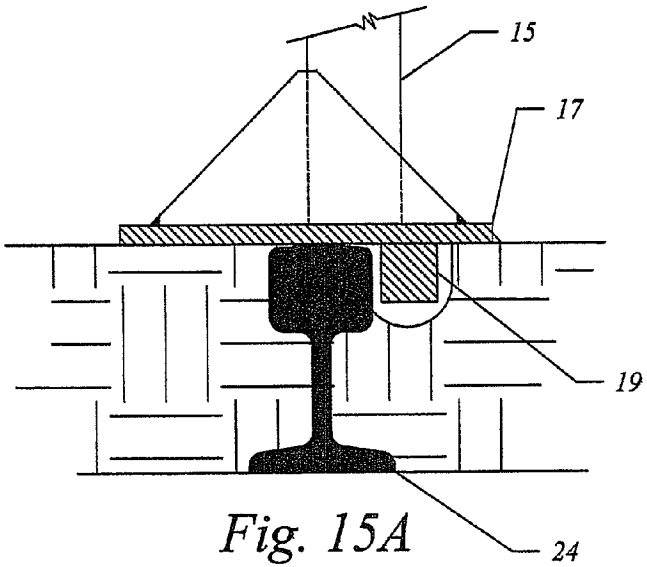
FIG. 15A is an enlarged view of the trailer landing gear base shoe.

Refer now to FIGS. 14 and 15 which show a typical trailer for transporting ISO containers. The trailer in FIG. 14 is comprised of (two) longitudinal beams 16 reinforced by multiple crossmembers (not shown) with a gooseneck at its forward end 16.1 and coupler sockets 22 at each end for coupling to the intermodal rail vehicle. Attached near the rear end of the trailer are tandem axles with wheels 20 and near the front end of the trailer a landing gear assembly is affixed. FIG. 15 shows the landing gear assembly fastened to the trailer frame members 16. Legs 15 telescope into tubes 18 by an arrangement of gears (not shown). Legs 15 have at their bottom ends, shoes 17, at the lower end of which are lugs 19, shown in FIG. 15A. These lugs are situated in a way that they will straddle the tracks near their inner edges, thus centering the trailer to the intermodal vehicle.

Train Make-Up Procedure

With reference now to FIGS. 1 and 2, an intermodal train of this invention is made up as follows. Initially a trailer will be positioned on the railroad track, with its front end facing the operation; the trailer can be aligned to the track by the lugs 19 on the landing gear legs 15. The intermodal vehicle is placed on the track with the "B" end facing the front of the trailer. Then the brakes on the trailer are set and the landing gear legs raised or lowered as required so that the intermodal vehicle can be pushed under its front end and the coupling tongue 62 on the intermodal vehicle enters the coupling socket 22 on the trailer. The rear end of the second trailer is pushed toward the "A" end of the intermodal vehicle; the bottom of the coupler socket of the trailer climbs the ramped end of the longitudinal beams 50 of the upper frame of the intermodal vehicle and is centered by the contact of the inner flange surface of the trailer frame rails 16 to the guide 36 on the lower frame of the intermodal vehicle until the coupler tongue 62 of the intermodal vehicle enters the coupler socket 22 on the rear end of the trailer. When the trailers are in position atop the intermodal vehicle, air can be introduced into the coupler pin actuators to raise the pins and into the air springs to raise the trailers for railroad operation. The foregoing steps will be completed with other intermodal rail vehicles and highway trailers until a suitable train is formed.

An Automatic Coupler

Figure 16:
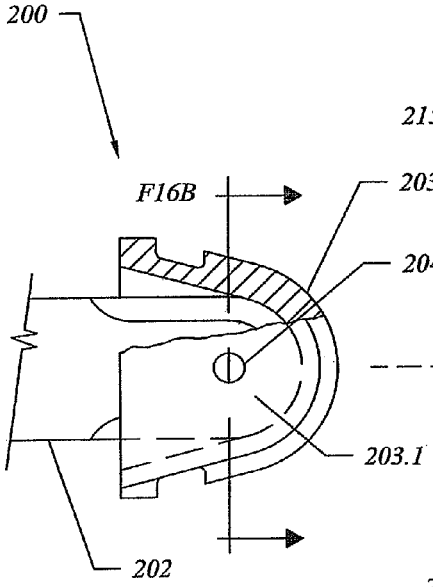
FIG. 16 is a plan view of the male coupler portion of an auto-coupler.
Figure 16A:
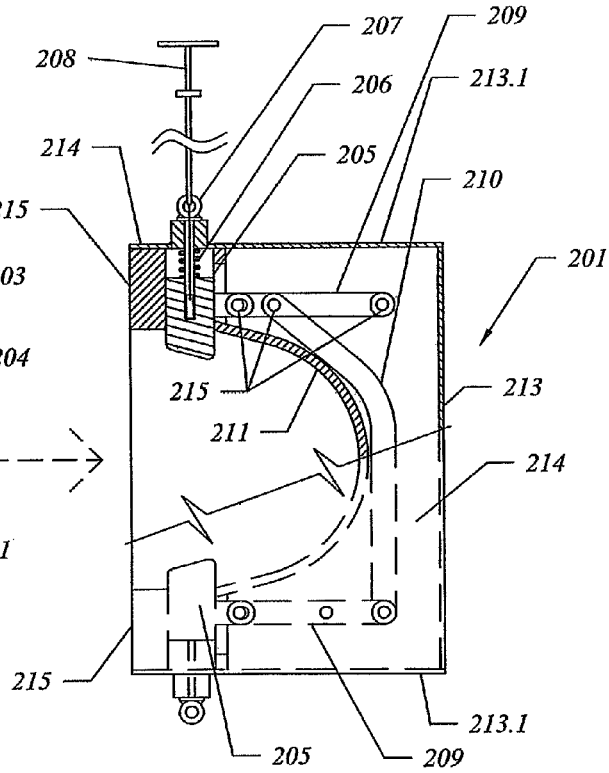
FIG. 16A is a plan view of the trailer socket during coupling operation.
Figure 16B:
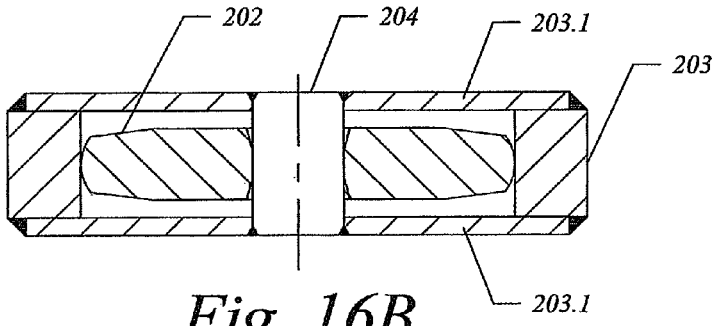
FIG. 16B is a cross-section of the male portion of the auto-coupler.
Figure 17:
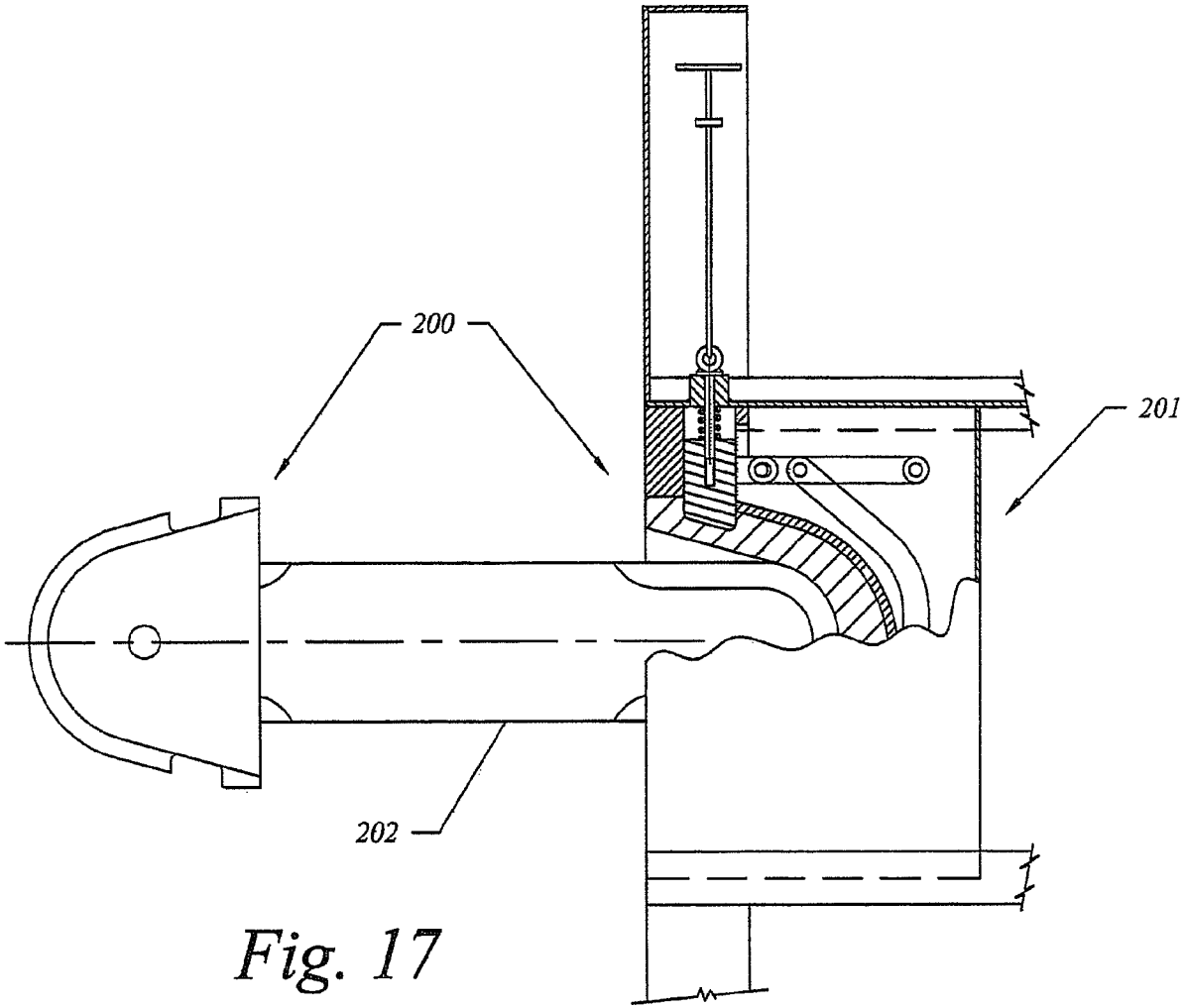
FIG. 17 is a plan view of auto-coupler in the coupled position.

As an alternate to the coupling method described above, it may be advantageous that an automatic coupling system be provided, especially for use with short, so called "sprint trams". Referring now to FIGS. 16, 16A, 16B and FIG. 17 which show an automatic coupler. FIG. 17 shows a unique female coupler socket 201 in the rear of a trailer and the corresponding male ends 200 attached to the top of the intermodal vehicle. FIG. 16 shows the detail of the male coupler end which is comprised of an outer contoured element 203 with an upper and lower cover plate 203.1, the combination of which is pivoted by pin 204 on coupler tongue 202. The aperture on tongue 202 into which the pin fits is "hourglass-shaped". That is, the upper and lower thirds of the opening are tapered so that the tongue can "rock" from side to side; additionally, the coupler tongue has a similar taper at its sides, and rounded edges where it contacts the inner surface of element 203. The male coupler end fits into the trailer socket 201 and specifically against inner surface 211. The coupler socket has two lugs 205 which are urged inward of the female socket assembly by springs 206. The two lugs are interconnected by a system of levers 209 and 210, pinned together by pins 215 and which may be operated outward by handle 208 connected to eyebolt 207. All of the above listed elements are enclosed within a "box" comprised of side members 213.1, end member 213, pressure block 215 and top and bottom plates 214, all of which making a box four inches thick and 35.5 inches wide installed between the frame members 16 at the rear and at the front of a trailer.

In the train make-up operation, the "B" end of the intermodal vehicle is pushed into the socket at the front end of a trailer and into the rear end of a second trailer as described in the above trailer make-up procedure. As male ends enter the female coupler sockets, they displace the lugs 205, which snap into the depressions on the contoured element 203 of the male end assembly thus effecting a coupling of the intermodal rail vehicle to the trailers. To disengage the couplers from the trailers, it is necessary to release the lugs by pulling on release lever 208, which releases both lugs through the interconnecting levers.

What is claimed is:

1. An improved intermodal rail vehicle to form a train of highway trailers including leading and trailing highway trailers which are interconnected to each other and supported by the intermodal vehicle for travel on railroad tracks, each of the highway trailers including a leading coupler socket assembly at one end and a trailing coupler socket assembly at the other end, each intermodal vehicle having two rail wheel assemblies, two lower frame assemblies into which each of the two rail wheel assemblies are mounted, an upper frame assembly supported on the lower frame assemblies by integral air springs, the upper frame including leading and trailing load carrying structures characterized by the provision of:

an integral drawbar assembly mounted on the upper frame assembly and extending above the leading and trailing load carrying structures, each end of the drawbar assembly of an associated highway trailer supported on an associated load carrying structure to connect the associated trailer to the intermodal vehicle, the drawbar assembly having a high end, which is vertically elevated relative to a low end thereof such that, when the the high end is engaged within the leading trailer coupler socket and the low end is engaged within the trailing trailer coupler socket, the trailers are coupled and run level and horizontal on the track.

2. An improved intermodal rail vehicle to form a train of highway trailers as set forth in claim 1 wherein:

two angle brackets are mounted so as to pivot on top of each end of the drawbar assembly and mounting at the outer ends of the two angle brackets urethane spring bumpers which exert a pressure upon the ends of the trailers when coupled to control slack between the trailers.

3. An improved intermodal rail vehicle to form a train of highway trailers as set forth in claim 1, further comprising:

a steering scheme wherein four vertical bars, screwed into fittings in the upper frame assembly at a longitudinal centerline thereof and spaced so that one vertical bar is positioned over four end channel crossmembers of the lower frames and passing through a hole in a block between a channel shape; said block being held in place by a urethane spring at each transverse end for spring resisted movement to return the vertical bars to the center as the lower framers steer along the tracks, wherein the vertical bars have at their bottom end a flange which functions as a stop to prevent the air springs from lifting the upper frame beyond a predetermined height and also to act as a stop so that the intermodal vehicle can be lifted by raising the upper frame assembly.

4. An improved intermodal rail vehicle to form a train of highway trailers as set forth in claim 1, further comprising:

a sloped ramp on the end of the upper frame assembly and a guide assembly mounted on the lower frame directly below the sloped ramp, the guide assembly configured to guide and center the trailer as the trailer is ramped upward to rest upon the upper frame assembly.

5. An improved intermodal rail vehicle to form a train of highway trailers as set forth in claim 1, further comprising:

an improved coupling between the lower frames consisting of plates from one lower frame made long enough so they touch the upper frame vertical surface of the opposite frame and connected by a vertical pin riding within a tapered bushing, and in addition the provision of two urethane bumpers on one lower frame assembly arranged to contact the other lower frame.

6. An improved intermodal rail vehicle to form a train of highway trailers, including leading and trailing highway trailers which are interconnected to each other and supported by the intermodal vehicle for travel on railroad tracks, each intermodal vehicle having two rail wheel assemblies, lower frame assemblies in which each of the two rail wheel assemblies are mounted, a unitary upper frame assembly supported on the lower frame assemblies, and air spring means for supporting the upper frame assembly in raised and lowered positions with respect to the lower frame assemblies, said improved intermodal rail vehicle comprising:

a backup suspension system for ensuring the upper frame is maintained in a raised position when desired, even in the event of a failure of the air springs, the backup suspension system including a plurality of urethane bumpers mounted to four side frame weldments of the lower frame assemblies and four shiftable pressure bars mounted to the upper frame slightly above said urethane bumpers so that in event of air spring failure, the upper frame will descend and be supported upon the urethane bumpers.

7. An improved intermodal rail vehicle to form a train of highway trailers including leading and trailing highway trailers which are interconnected to each other and supported by the intermodal vehicle for travel on railroad tracks, each of the highway trailers including a leading coupler socket assembly at one end and a trailing coupler socket assembly at the other end, each intermodal vehicle having two rail wheel assemblies, two lower frame assemblies into which each of the two rail wheel assemblies are mounted, an upper frame assembly supported on the lower frame assemblies by integral air springs, the upper frame including leading and trailing load carrying structures, the intermodal rail vehicle comprising:

an automatic coupling means; said automatic coupler consisting of male end assemblies attached to the ends of coupler tongues mounted to the upper frame, and mating female coupler socket assemblies mounted at the ends of highway trailers, the coupler sockets having spring loaded latch bars which snap into notches in the male coupler assembly when it enters the coupler socket, thus forming a connection between the male and female elements until said connection is released by moving the latches out of contact within the notch.

* * * * *